US012029264B2

(12) United States Patent
Kerr et al.

(10) Patent No.: US 12,029,264 B2
(45) Date of Patent: Jul. 9, 2024

(54) STIFFNESS AND LUMINESCENT TEXTILES FOR GARMENTS

(71) Applicant: Zhik Pty Ltd, Artarmon (AU)

(72) Inventors: Andrue Kerr, Artarmon (AU); Ryan Paxton, Artarmon (AU)

(73) Assignee: Zhik Pty Ltd, Artarmon (AU)

( * ) Notice: Subject to any disclaimer, the term of this patent is extended or adjusted under 35 U.S.C. 154(b) by 0 days.

(21) Appl. No.: 16/891,222

(22) Filed: Jun. 3, 2020

(65) Prior Publication Data

US 2020/0375278 A1 Dec. 3, 2020

(30) Foreign Application Priority Data

Jun. 3, 2019 (AU) ..... 2019901893

(51) Int. Cl.
*A41D 13/012* (2006.01)
*D02G 3/22* (2006.01)
*A41D 7/00* (2006.01)

(52) U.S. Cl.
CPC ..... *A41D 13/012* (2013.01); *D02G 3/22* (2013.01); *A41D 7/00* (2013.01); *A41D 2200/20* (2013.01); *A41D 2500/10* (2013.01); *A41D 2600/10* (2013.01)

(58) Field of Classification Search
CPC .. D02G 3/02; D02G 3/12; D02G 3/16; D02G 3/18; D02G 3/44; D02G 3/41
See application file for complete search history.

(56) References Cited

U.S. PATENT DOCUMENTS 3,654,056 A * 4/1972 Nisbet et al. ..... D03D 27/00 428/97
5,119,512 A * 6/1992 Dunbar ..... A41D 19/01511 2/167
5,876,834 A * 3/1999 Foy ..... A41D 31/245 428/192
6,289,702 B1 * 9/2001 Heirbaut ..... C03B 40/005 66/202
11,129,427 B2 * 9/2021 Shigaki ..... A41D 19/01
2004/0142618 A1 * 7/2004 Porter ..... D03D 9/00 442/266
2005/0009428 A1 * 1/2005 Porter ..... B32B 37/24 442/129
2008/0113175 A1 * 5/2008 Ke ..... B32B 5/02 428/221
2011/0023695 A1 * 2/2011 van Heerden ..... D06M 15/227 89/36.02
2015/0118425 A1 * 4/2015 Dapsalmon ..... D02G 3/442 428/36.1
2016/0032182 A1 * 2/2016 Agrawal ..... D06P 1/0012 427/157
2017/0173370 A1 * 6/2017 Underwood ..... A41D 31/085
2017/0203540 A1 * 7/2017 Colatruglio ..... B32B 7/09
2019/0017785 A1 * 1/2019 Morag ..... B32B 38/04
2019/0160782 A1 * 5/2019 Harding ..... B32B 7/03

* cited by examiner

*Primary Examiner* — Richale L Quinn
(74) *Attorney, Agent, or Firm* — Nixon & Vanderhye P.C.

(57) ABSTRACT

A garment for watersports formed with at least one textile. The textile comprising a face fabric and a membrane. The membrane being fixed to the face fabric and wherein the textile comprises primary yarns and secondary yarns in which the secondary yarns have a higher stiffness relative to the primary yarns.

15 Claims, 4 Drawing Sheets

STIFFNESS AND LUMINESCENT TEXTILES FOR GARMENTS

CROSS-REFERENCE TO RELATED APPLICATIONS

This application claims priority to Australian Provisional Application No. 2019901893 filed Jun. 3, 2019, the entire contents of each of which are hereby incorporated by reference.

TECHNICAL FIELD

The present disclosure relates to a textile for stiffening and/or luminescence. More particularly, the present disclosure is directed towards a textile formed with at least one of a luminescent region, a stiffened region and reinforced region.

BACKGROUND

Water resistant and wind resistant clothing, including waterproof and windproof jackets and other clothing, often have incorporated combinations and sequences of different layers, and different materials for warmth, a micro-porous membrane layer for vapor permeability, and/or a hydrophobic layer for truly effective waterproofing and windproofing.

This clothing has often been adapted only for specific seasonal or sporting purposes or conditions. Single layer waterproof and windproof shells are adapted for use in a variety of seasonal and/or inclement conditions in the sense that the wearer can select a sweater and/or other underlying garment to meet individual needs or preferences. In the past, single layer waterproof and windproof shells for clothing are not suitable to provide for both wind resistance and waterproof resistance for watersporting activities.

Further, sewing or fixing further layers of textiles will generally impact the waterproof and windproof properties of the clothing. Furthermore, such shells generally do not have the acceptable comfort for prolonged use or comfort after prolonged exposure to water. In view of the above, it may be desirable to provide for clothing which has as few layers as possible such that the waterproofing and windproofing properties of the clothing can be improved.

Water resistant and wind resistant clothing, including waterproof and windproof jackets and other clothing, often have incorporated combinations and sequences of different layers, such as a fleece or wool layer for warmth, a microporous membrane layer for vapor permeability, and/or a hydrophobic layer for truly effective waterproofing and wind-proofing. Such jackets often have been adapted only for specific seasonal and/or inclement conditions.

Waterproof garments, such as jackets and coats are generally formed with a waterproof plastic, rubber, or chemically treated woven material. Sweat from the user will generally not penetrate the shell material as the shell is a waterproof material, and wicking materials may be provided as a lining to wick away sweat to improve the comfort of the user. It may also be common to provide, between the face fabric and textile lining, a waterproof but water vapor permeable functional layer may be provided, such as polytetrafluoroethylene (PTFE) or polyurethane (PU).

If water does ingress into the clothing, which may be due to saturation of the face textile or may be due to fluids entering into the garment via the collar, sleeves, or other openings of the garment. This can increase the discomfort of the wearer substantially and make the garment unsatisfactory for prolonged use.

Further, there are a number of issues in relation to wearing high-visibility garments and often persons in higher risk environments will elect not to wear garments with a correct or appropriate level of visibility as they believe that these garments are undesirable in appearance. As such, this can increase the potential for an accident to occur.

In view of the above it may be beneficial to provide for an improved garment which may offer superior water-resistant properties, or improve the comfort of the wearer during use.

Any discussion of the prior art throughout the specification should in no way be considered as an admission that such prior art is widely known or forms part of common general knowledge in the field.

SUMMARY

Problems to be Solved

It may be advantageous to provide for a textile which has improved stiffness or rigidity.

It may be advantageous to provide for a garment with a stiffened face fabric.

It may be advantageous to provide for a textile which comprises a light fabric which has a desired rigidity.

It be advantageous to provide for a textile with at least one fibre to provide stiffness.

It may be advantageous to provide for a phosphorescent material or pigment in a textile.

It may be advantageous to provide for a garment with a phosphorescent material or pigment which can be concealed behind an outer layer of textile.

It may be advantageous to provide for a garment with improved visibility.

It may be advantageous to provide for a garment with improved visibility in predetermined conditions.

It may be advantageous to provide for a garment which can improve comfort of the wearer during use.

It may be advantageous to provide for a garment which can be used in contact watersports, or watersports which require repeated contact with equipment.

It is an object of the present invention to overcome or ameliorate at least one of the disadvantages of the prior art, or to provide a useful alternative.

Means for Solving the Problem

A first aspect of the present invention may relate to a garment for watersports. The garment comprising a textile comprising a face fabric and a membrane, the membrane being fixed to the face fabric; and wherein the textile comprises primary yarns and secondary yarns in which the secondary yarns have a higher stiffness relative to the primary yarns.

Preferably, the secondary yarns comprise at least one filament selected from the following group: glass, aramid, ceramic, graphite (or carbon), metal alloys and metal fibres. Preferably, a knitted layer may be disposed adjacent to the membrane. Preferably, the knitted layer and the first layer are disposed on respective sides of the membrane. Preferably, luminescent materials may be provided to at least one face fabric and the membrane. Preferably, the garment further comprises a hood. Preferably, the stiffening yarn may be a first stiffening yarn, such that a seat region of the coat may be formed with a second stiffening yarn of a relatively larger denier than the first stiffening yarn. Preferably, predetermined regions of the garment are formed with a reinforcing structure. Preferably, the reinforcing structure may be formed from the secondary yarns.

Another aspect of the present invention may relate to a textile for forming garments. The textile may comprise a first layer, and a second layer. The first layer being a face fabric comprising warp and weft yarns. The second layer being a membrane disposed on one side of the first layer and wherein the first layer comprises a plurality of primary yarns and secondary yarns, wherein the secondary yarns have a shape imparting feature.

Preferably, the secondary yarns are resiliently biased. Preferably, the secondary yarns are a reinforcing structure. Preferably, the secondary yarns form an abrasion resistant structure. Preferably, the first layer may comprise a film layer and a base layer. Preferably, the film layer may be a chromic material selected from the following group; dyes, pigments, conjugated conducting polymers, oxides, and organic molecules.

In the context of the present invention, the words "comprise", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

DESCRIPTION OF THE INVENTION

Preferred embodiments of the invention will now be described with reference to the accompanying drawings and non-limiting examples.

REFERENCE TERMS

10—Garment
20—Sleeve
30—Front panel
40—Rear panel
50—Hood
55—Collar
60—Upper end
70—Lower end
80—Seat region
100—Textile
102—First section
104—Second section
105—Reinforced structure
110—Primary fibres/yarns
120—Reinforced fibres/yarns
130—First layer/Face layer
140—Second layer/Membrane
150—Third layer/Knit layer
160—Coating
170—Reflective elements
180—Luminescent coating
190—Abrasion fibres
196—Transition zone Garments 10 for use in watersports or for use in prolonged wet conditions are generally required to keep the wearer as dry as possible for as long as possible in the wet conditions. Maintaining dryness of the wearer can improve the comfort of the wearer and may allow the wearer to continue working or enjoying a watersport for a longer period of time.

Typically, functional coatings 160 can be provided to a garment to assist with waterproofing or water-repellency. However, while these functional coatings are generally useful for small volumes of water or short-term use, prolonged exposure may cause water to penetrate into the textile coated with said functional treatment. These problems are only exacerbated at stitches or regions which connect layers or fabrics together unless suitable seals are provided to the garment. Further, once water has entered into the garment, it is difficult for the liquid to drain from the garment and may discomfort the wearer, or increase undesirable windchill effects experienced by the wearer. This may cause the wearer to need to take cover or remove the garment in an attempt to dry said garment before further wear.

In view of the above problems, the present disclosure provides a number of novel garment configurations and garment textiles which may be suitable to overcome or ameliorate these problems.

Support Structure

One method for improving the comfort of a user is to reduce contact between the wearer and the garment 10. As such, the garment 10 may be formed such that an air gap can be made between the garment 10 and the wearer in as many places as possible, or in predetermined locations of the garment 10, to assist with maintaining dryness to the wearer during use in wet environments, such as on a sailing vessel. Air gaps can improve drying of wet garments 10 as improved airflow between the textile 100 and the wearer and increase the drying speed.

Figure 1:
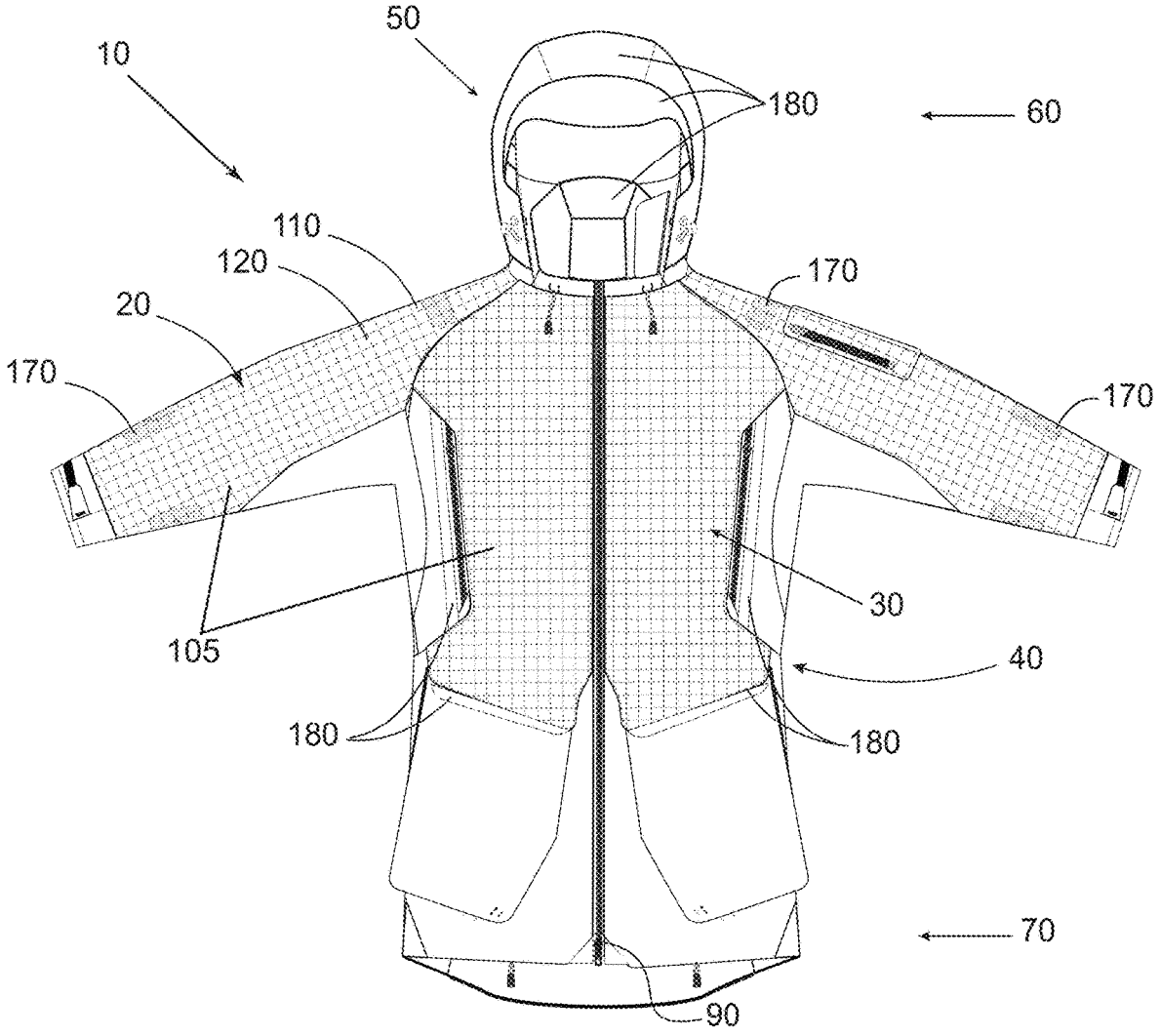
FIG. 1 illustrates an embodiment of a garment constructed from a stiffened textile with luminescent regions.

Referring to FIG. 1, there is illustrated an embodiment of a garment 10 formed from a textile 100 with a reinforced structure 105. The reinforced structure 105 includes primary yarns 110 and secondary yarns 120. The reinforced structure 105 may have a number of reinforced yarns in the warp and/or weft directions with the primary yarns 110 forming more than 50% of the surface area of the textile 100. Secondary yarns 120 may be used to stiffen or provide shape to a textile, and may be the reinforcing elements of the reinforcing structure 105. The reinforced fibres, or secondary yarns 120, may have a relatively thicker denier or a higher stiffness relative to primary fibres 110 of the textile 100.

The garment 10 as illustrated comprises a pair of sleeves 20 attached to a front panel 30 and a rear panel 40. The front panel 30 and the rear panel 40 are joined at a seam, and collectively form a torso portion of the garment 10. In another embodiment, the front panel 30 and the rear panel 40 can be formed as an integral section of the garment 10 and therefore the panels are not joined at seams. The front panel 30 of the garment 10 can be formed with a zipper or other fastening means to allow for easy donning and doffing of the garment 10.

In another embodiment, the front panel 30 and/or the rear panel 40 of the garment comprise a plurality of portions fixed together to form said panels 30, 40. For example, the front panel 30 may be formed from a centre portion 32, and a pair of side portions 34. Optionally, the portions of the front panel 30 may be formed from two or more materials. If the portions are formed from two or more materials, each material may impart a desired mechanical property to the garment, such as flexibility, stiffness, elastic deformation, abrasion resistance, rigidity, water repellency, and thickness.

A hood 50 is shown connected to the upper end 60 of the garment 10 which can be used to protect the head of the wearer from environmental conditions, such as water and wind, when in use. The hood 50 as illustrated in FIG. 1 also shows several portions which may be imparted with a luminescent material. Optionally, the hood 50 may be removable, or stowable in the collar or rear panel 40 of the garment, sees FIGS. 6 and 7 for example.

The lower end 70 of the garment 10 may be formed with a seat region 80. The seat region 80 will be the region of the garment 10 which is generally near to the buttocks of the wearer, such that when the wearer is sitting or leaning against equipment the seat region 80 the potential for damage which could increase the potential liquid ingress into the garment. Typically, water or rain will generally be the primary source of liquid which would ingress from external the garment to internal the garment. As these conditions are likely to be experienced while wearing the garment, limitation of water ingress and improved drying of the garment 10 may be advantageous.

The reinforcement structure 105 may be used not only to stiffen or impart a desired shape to the textile 100 forming at least a portion of the garment 10, but may also be used to space the garment 10 from the body of the wearer. Spacing the garment from the body of the wearer can assist with improving the drying rate of the garment when worn and may also improve the warmth of the wearer and assist with cutting windchill experienced by the wearer. These benefits may improve the overall comfort of the wearer. Regions of spacing for the garment may be locations where reinforcing structure textiles are provided. These regions are generally illustrated as the latticed regions of the garment as illustrated in FIG. 1, for example. Other regions may also be provided with a reinforcing structure 105 which can impart a desired shape or allow for deformation in a desired manner. While the reinforcing structure 105 is shown as a lattice, other structures such as triangular structures, helix structures, regular polygon structures or ordered/regular arrays can be used to form the reinforcing structure 105.

It is preferred that the structure 105 is elastically deformable, such that when the garment is worn, the wearer can bend, flex, deform or otherwise manipulate the structure of the textile forming the garment, at least temporarily.

The spacing of the garment from the wearer may provide a maximum air gap in the range of 5 mm to 100 mm, but more preferably in the range of 5 mm to 40 mm. The desired spacing will depend on the garment 10 reinforced structure 105 and the expected saturation level of the garment 10. Different secondary yarns 120, or reinforcing structures 105, may be provided in different regions to impart a desired rigidity, stiffness, movement, elasticity or other desired property to the garment 10.

Figure 2:
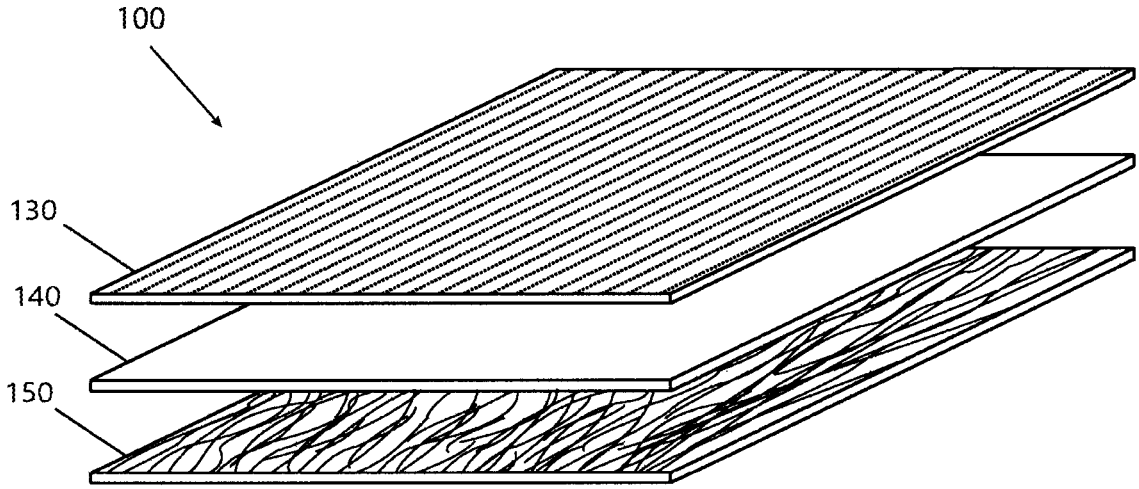
FIG. 2 illustrates an embodiment of an exploded view of a reinforced textile suitable for use in forming a garment.

An exploded view of an embodiment of the textile 100 used to form a portion of garment 10 is illustrated in FIG. 2. The textile 100 illustrated comprises a face fabric 130, a membrane 140 and a knitted layer 150 or other inner fabric layer 150. Optionally, the knitted layer 150 may be a woven layer 150, scrim layer 150 or an insulation layer 150. Optionally, the membrane 140 may comprise more than one substrate, such as a combination of PTFE and PU layers, or any other combination of polymeric membrane substrates combined, fixed or adhered together. The thicknesses of the membrane 140 may be any predetermined thicknesses or may be in the range of 0.001 mm to 3 mm thick.

The face fabric 130 may be provided with at least one reinforced structure 105 (illustrated as dotted lines) formed from a reinforced fibre or secondary yarn 120 which can increase the stiffness or rigidity of a garment 10.

The knitted layer may be a warp knit layer, such as a tricot layer 150. Other knitted constructions may also be used to form the knitted layer. Tricot layers 150 may be a wicking layer for wicking moisture within the clothing, such as sweat or fluids which have entered into the garment. It is preferred that any moisture transferred to the tricot 150 can be moved away from the body of the wearer as quickly as possible. The membrane of the textile can be used to assist with liquid and vapour transfer from the tricot layer and direct the vapour or fluids external the garment, Improving dryness of the user may also improve the overall comfort of the wearer.

The reinforced structure 105 may bias a garment 10 in a desired shape or position relative to the body of the wearer. The reinforced structure 105 may be a mesh or plurality of parallel yarns or elements which provide a desired rigidity to a textile, such as a face fabric of the textile. The reinforced structure 105 is preferably fixed, woven, knitted or glued to the yarns forming the face fabric 130 of the textile 100. Optionally, the reinforced structure 105 may be doped or imparted with a luminescent property 180 which may be visible through the yams of the face textile during low light conditions (provided that the luminescent material has been energised sufficiently). Energising of the luminescent material can be achieved by exposing the luminescent material to an energy source such that the luminescent material emits light in the range of infrared to ultraviolet wavelength spectrums.

The reinforced structure 105 may be reflective which can also be used to improve the safety of a wearer of the garment as they can be more visible. Reflective elements 170 also be positioned on the garment and be formed from typical reflective materials found in the art.

The reinforced structure 105 may be formed, at least in part, from a metal or metal alloy. Reinforced structure 105 may be in the form of yarns or may be formed from a mesh or strip of reinforced substrate. Any metals used for the reinforced structure 105 are preferably corrosion resistant or have a coatin2 160 which can resist or prevent corrosion. Suitable coatings may include painted coatings, heat shrink coatings, depositions, films, polymer coatin2s, metallic coatings, or coatings which prevent corrosion, or provide a chemical barrier or physical barrier for materials. It is preferred that coatings applied to metals are not hydrophobic.

Wind and chill effects for the wearer may be reduced by using a stiffened textile to make the garment as the garment can be held away from the body of the wearer when in use. Further, using a stiffened textile may also while also minimising discomfort from wearing a rigid textile.

It is preferred that the stiffened textile is elastically deformable, such that when at rest the textile will impart a predetermined shape to the garment formed therefrom. In this way portions of the garment can be spaced from the body of the wearer to allow air flow and improve the speed of drying when wearing the garment and/or improving the warmth of the garment and breathability of the garment. Structures may also be used to trap air or direct airflow when being warn.

It will be appreciated that any predetermined fibres120 may be used to impart a desired stiffness to the garment. For example, metal alloys or polymers may be used as the fibres 120.

Figure 3:
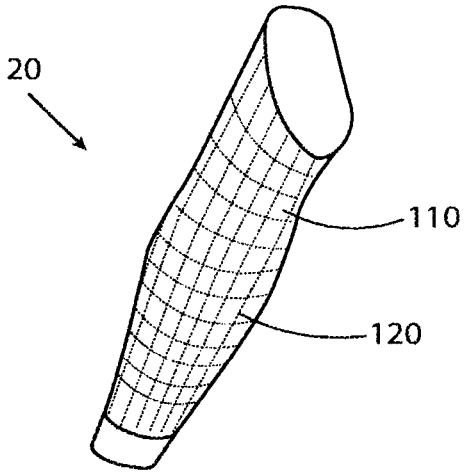
FIG. 3 illustrates an embodiment of a sleeve of a garment constructed with a reinforced textile.
Figure 4:
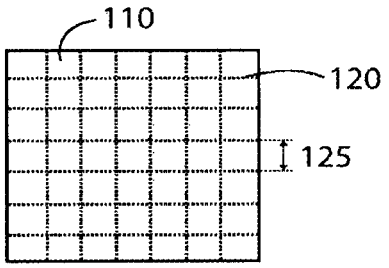
FIG. 4 illustrates an embodiment a reinforced structure in a textile for use with a garment.

Referring to FIG. 3, there is shown an embodiment of a sleeve for a garment constructed with a lattice reinforcing structure 105. The primary yarns 110 being 70% or greater than the total yarn mass of the face fabric 130, and the secondary yarn 120 being used to impart a desired shape to the textile 100.

Abrasion Resistant Structure

Other desirable properties for a garment may include abrasion resistant properties or cut resistant properties. Abrasion resistant properties may assist with maintaining the integrity of waterproof and/or windproof properties of the garment 10. Abrasion resistant structures 190 may be used to reinforce or protect regions of the garment which are likely to come into contact with sharp or pointed elements, repeatedly contact equipment, or be used to sit, lean, rest upon or generally receive higher wearing than other portions of the garment. Reinforcement structures 105 and abrasion resistant structure may be the same elements, or formed from the same materials or formed from substantially the same materials. One region of the garment which will receive significant wearing or use is the seat region of the garment, and/or the elbow region of a garment having arms.

Figure 5:
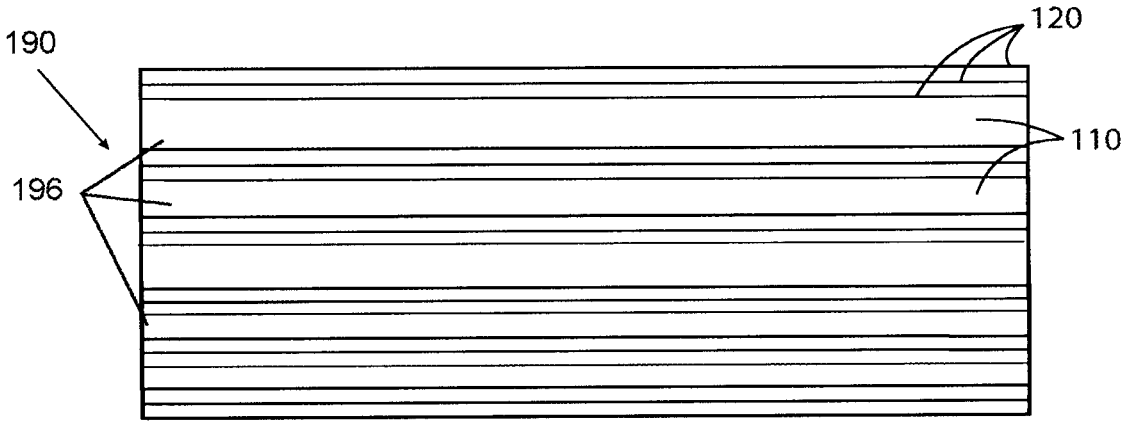
FIG. 5 illustrates an embodiment of a reinforced textile with a transition zone with for use with a garment.
Figure 6:
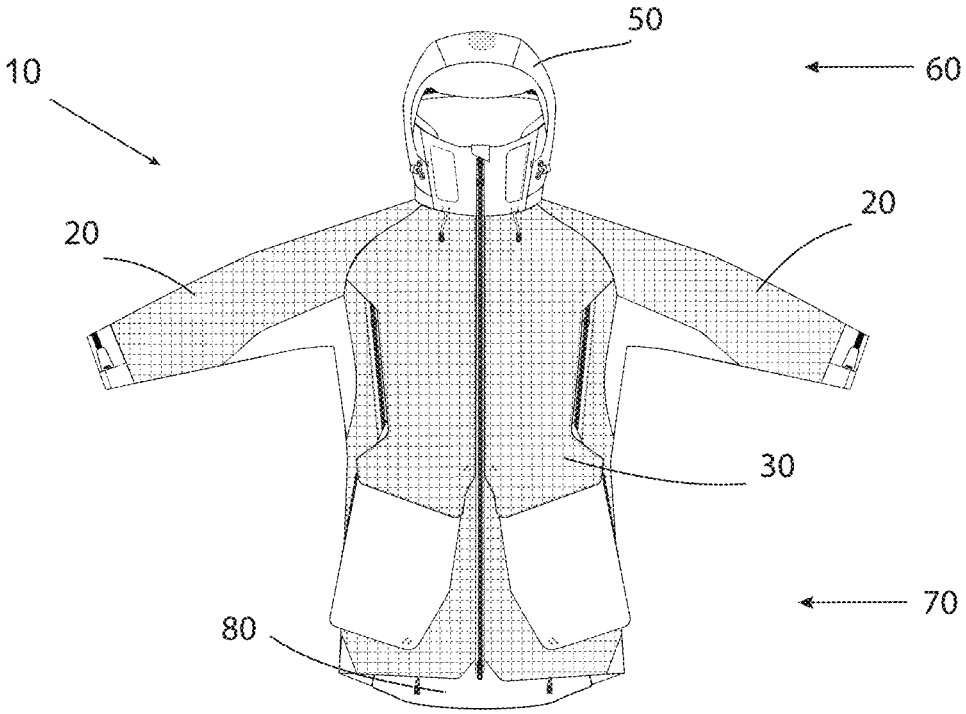
FIG. 6 illustrates an embodiment of a front view of a garment with a stiffened textile incorporated therein.
Figure 7:
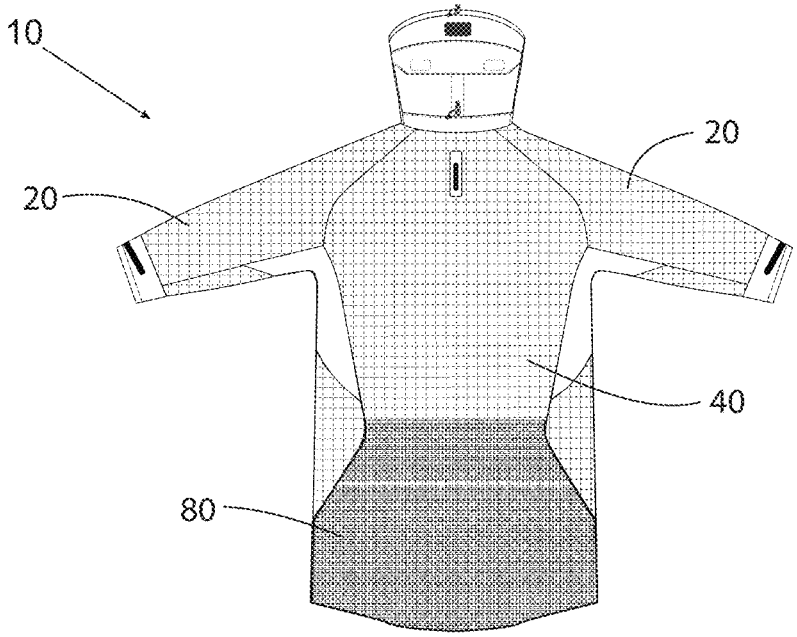
FIG. 7 illustrates an embodiment of a garment with an abrasion resistant seat portion formed on the rear side.

Abrasion resistant structures may also be suitable for cut resistance, which may be beneficial for garments used for fishing or for use in rocky areas near the water which may have sharp obstacles or sharp environments. Cut resistance and slash resistance for the textile may be provided by a predetermined array or structure formed at the outer surface of the textile 100. An example of abrasion resistant structures is shown in FIG. 5. Preferably, any abrasion resistant or cut resistant structures are formed with an absorbent material, gel or force absorbing means which can slow impacts and distribute energy through the abrasion structure to reduce the potential for slashing, cutting or other damage to the textile 100. A regular array or pattern of elements may be used to provide said force absorbing means and can be arranged in a regularly spaced geometric formation. FIG. 5 illustrates a transition zone 196 in which secondary fibres 120 have wider spacing at the upper end and closer spacing near to the lower end. In this way, the abrasion resistant properties of the textile (or garment formed therefrom) can be varied. An example of a garment with an abrasion resistant seat region 80 is illustrated in FIGS. 6 and 7.

Figure 8:
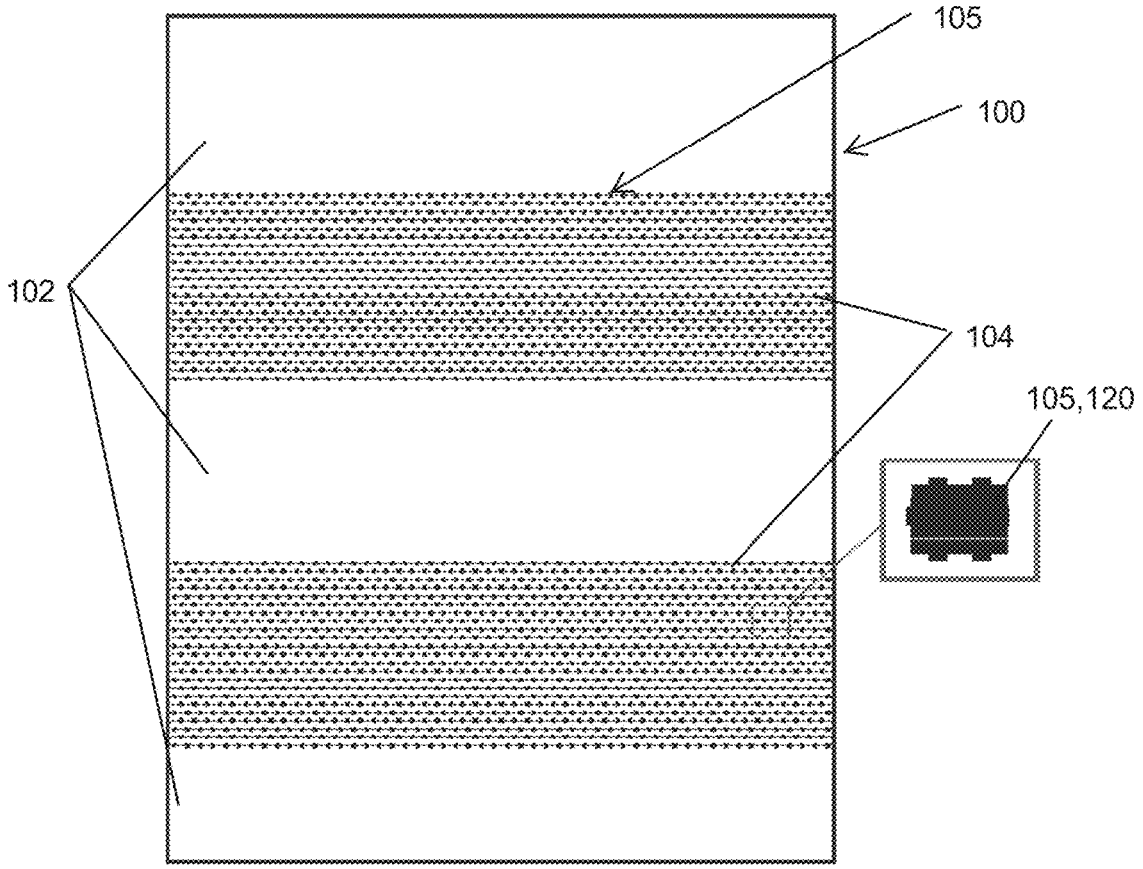
FIG. 8 illustrates an embodiment of an abrasion resistant textile with discrete sections comprising a reinforced structure or a plurality of abrasion resistant nodes.
Figure 9:
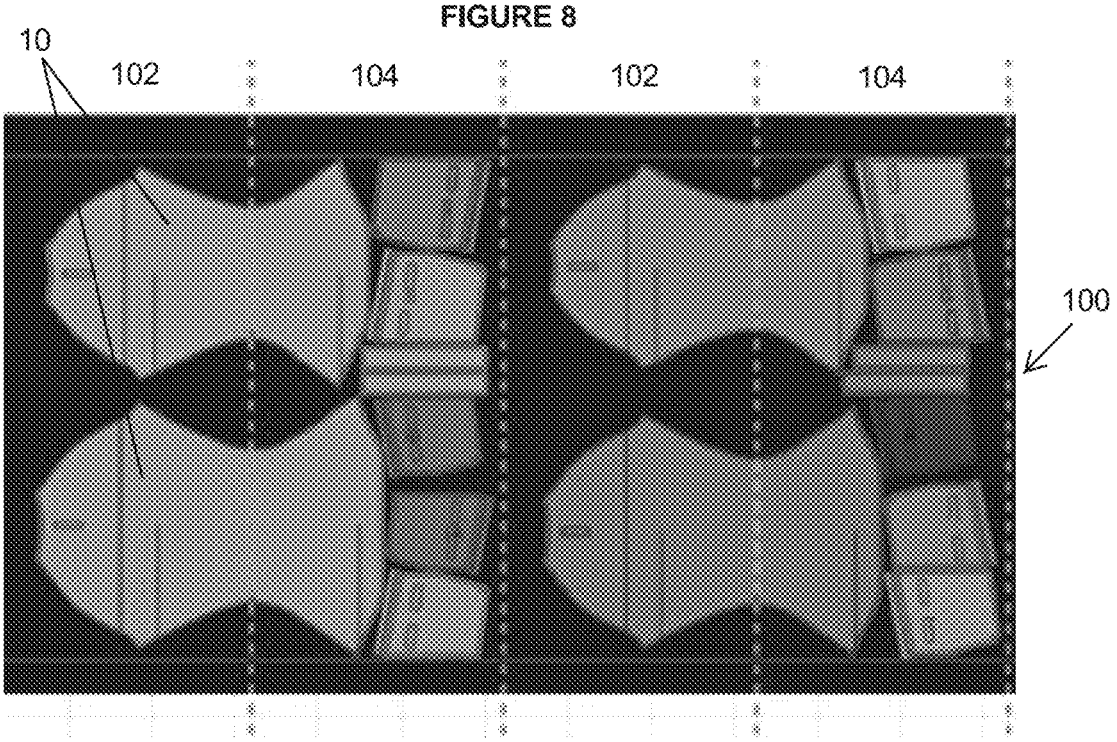
FIG. 9 illustrates an embodiment abrasion resistant textile which is suitable for forming garments.

Referring to FIG. 8, there is illustrated a further embodiment of an abrasion resistant textile 100 which can be used to form a garment 10. The textile 100 is fabricated with a first portion and a second portion. The first portion may be a woven, knitted or braided textile and the second portion further comprises a reinforced structure 105. The reinforced structure 105 may be uniformly spaced and of a uniform pattern or regular pattern. For example, the pattern may be a dobby pattern or a spaced regular array of nodes or elements which form the reinforcing structure 105. First and second portions may alternate and be of a predetermined length to allow for garments to be constructed with as little wastage as possible. Referring to FIG. 9, there is shown an embodiment of garment outlines for a plurality of garments which can be formed with a first section 102 and a second section 104 of abrasion resistant textile 100 which includes the reinforcing structure 105.

The length of the first section 102 and the second section 104 may each be in the range of 20 inches to 40 inches. In a specific embodiment, the length of the first section 102 and the second section 104 are each in the range of 25 inches to 30 inches, and even more preferably is around 27 inches. The length of the first and second sections 102, 104 will depend on the garments being formed, and it will be appreciated that the first section and the second section need not be of equal lengths.

In yet another embodiment, the first section 102 and the second section 104 are formed as continuous sections in the warp direction, rather than as discrete sections formed in the weft direction as is illustrated in FIGS. 8 and 9. The advantage for fabricating a textile 100 with two discrete sections is that tape seams or other seams use to form the garment 10 can be less complex compared to traditional methods of garment fabrication using two different textiles. This is exemplified in FIG. 9 wherein the garments are aligned to be cut from the first and second sections with as little wastage as possible, but having the reinforcement structure 105 aligned to a desired orientation for the garment reduce seam locations.

Laminations (not shown) can also be provided to absorb force and improve abrasion resistance of the textile 100 forming the garment 10. While laminations can be used to improve abrasion resistance or cut resistance of the garment 10, the yarns forming the face fabric of the garment 10 are preferably adapted to provide at least one of the abrasion resistance and/or cut resistance.

The reinforcing structure 105 and/or abrasion resistant structure or system may be formed from any material or materials suitable for forming a continuous network or a discontinuous array of discrete elements of the desired size, shape, and spacing. Preferably, the reinforcing structure 105 is substantially non-absorbent or waterproof. In a preferred embodiment, the reinforcing system (or reinforcing structure 105) is formed from and/or treated with a functional coating which can repel fluids. For other applications the reinforcing system may be formed from and/or treated with a material which tends to cause the fluids of interest to "wet out" on the surface, such as hydrophilic, lipophilic, or other types of materials. Suitable reinforcing materials include polymeric film bonded or laminated to the absorbent layer, thermoplastic, thermoset, or crosslinked resins or thermoset foams directly cast, printed, or extruded onto the absorbent layer, coated paper or cardboard bonded to the absorbent layer by adhesives or the like, etc. The abrasion resistant structure may comprise one layer of material or may comprise a laminate structure having multiple layers of the same or diverse composition. Reinforcing structures 105 and systems may have any desired denier or caliper suitable for a particular application. For example, the yarns used to form the abrasion resistant textile 100 may have a first yarn with a denier in the range of 250 D to 350 D, a second yarn with a denier in the range of 800 D to 1200 D, and a third yarn with a denier in the range of 50 D to 150 D. In a specific example, the denier used to form the reinforcing structures 105 are 70 D, 1000 D and 320 D and are clustered to make a node or element which projects from the outer surface of the textile 100. An enlarged reinforcing structure 105 can be seen in FIG. 8. The structure 1005 shown is exemplary only and other structures 105 may be formed depending on the weaving, braiding, or attachment method used. Optionally, one or more of the yarns may be an elastic yarn or a stretchable yarn which can elastically deform to allow for a stretch in one or more directions.

Abrasion fibres may be formed from a plurality of closely woven weft or warp yarns which have a generally larger diameter than the primary fibres of the fabric, or may be formed from fibres which comprise a metal or metal alloy.

A garment 10 may be formed from a combination of abrasion resistant textiles and common textiles in the art. Preferably, abrasion resistant textiles or fibres may be provided in the regions which are likely to experience contact when in use. For example, the sleeves 20 and seat region 80 of a garment 10, such as those of the coat illustrated in the FIGS. 6 and 7. The regions of the garment 10 illustrated without a reinforcing structure 105, however any predetermined region of the garment may be provided with one or more reinforcing structures 105. It will be appreciated that as reinforcing structures 105 or abrasion resistant structures can be integrally formed with the face fabric, patches or further materials need not be fixed to the garment, which can reduce weight and reduce failure locations, such as stitching locations or poor breathability locations being formed in the garment 10.

To improve the rigidity of a garment 10 while also maintaining a desired comfort level and also maintaining a desired drapability. Portions of the garment may be imparted with a higher degree of flexibility or a higher level of drapability.

The garment 10 as illustrated may be formed from a stiffened textile and at least one membrane. Preferably, a tricot layer 150 is provided on one side of the membrane and the stiffened textile is disposed on the other side of the textile.

An undulation or corrugation can be imparted to the knitted layer, or a further layer applied to the membrane. The undulations may impart a predetermined stiffness or desired deformation. This type of undulation structure is exemplified by FIG. 5.

The stiffening textile may be used as a face fabric to impart a desired shape to the exterior of a garment. The exterior shape of the garment can be used to space the garment from the body of a wearer and can be used to assist with drying of the garment and keeping the wearer dry and/or warm.

The textile may be stiffened by introducing thicker or more dense denier weft yarns into the textile. It will be appreciated that the spacing of such textile yarns may also be used to improve abrasion resistance of a garment.

The stiffening yarns of the textile may be a reflective material, a phosphorescent material, or a luminescent material. Each of the stiffening yarns may be formed from a more rigid material, and/or may have a thicker denier than the other yarns of the textile. In yet another embodiment, the stiffening yarns may be a yarn which has a higher stiffness relative to the yarns adjacent to the stiffening yarn.

In a further embodiment, the stiffening yarns may be a plurality of yarns woven more closely than the density of the surrounding yarns. An embodiment of this is illustrated in FIG. 5, where a transition zone 196 to an abrasion resistant region is illustrated. Each of the parallel horizontal yarns of the textile illustrate an abrasion resistant yarn at differing spacing.

The textile may have a stiffness imported by the inclusion of a denier yarn with a denier at least 100% larger than the denier of the primary yarns of the textile. For example, if the primary yarns of the textile are 120 denier, the stiffening yarns will be 240 denier. Preferably, the primary yarns have a denier of between 100 to 200 denier, and the stiffening yarns have a denier of between 200 to 400 denier.

It is preferred that the exterior of the garment is coated with at least one of a waterproof treatment or water-repellent treatment. Other functional coatings may be applied to the textiles of the garment 1 to impart a desired property thereto.

Optionally, the textile further comprises weft yarns which include a material which can improve abrasion resistance of the textile. It will be appreciated that the abrasion resistance yarns and the stiffening yarns may be the same yarns.

Regions of the garment 1 may be provided with regions with a higher abrasion resistance that other regions of the garment. The primary regions for abrasion resistance are preferably near to the regions which are likely to come into contact with objects or surfaces. For example, the seat area of the garment may have abrasion resistant properties to assist with comfort of the wearer when sitting or leaning on the seat area. Abrasion resistant structures or structures may be provided in predetermined locations on the garment and can assist with reducing the overall weight of the garment as additional material layers are not required to be sewn, stitched or fixed to these regions.

Abrasion resistance fibres or yarns may be woven, knitted or braided into the structure. Preferably, the abrasion resistant structures are only disposed in predetermined regions of the garment. These materials may also assist with reducing the amount of material required for the garment, as well as allowing for fewer stitching locations to be present in the garment. Stitching locations are primarily locations for waterproof failures to occur and garments may therefore be unusable if these stitches fail.

In addition to reducing the overall weight of the garment, the use of a single material also provides for a thinner garment which can improve the movement of the wearer and also the comfort of the wearer.

Yarns for use in stiffening the textile may include yarns with at least one of; glass, aramid, ceramic, graphite (or carbon) and metal fibres. Yarns for stiffening may be any predetermined yarn which can increase the stiffness of the textile 100 relative to forming the garment 100 exclusively from primary yarns 110.

Optionally, the stiffening yarn may also be reflective and/or phosphorescent. The stiffening yarn may be formed from a plurality of filaments which may be of uniform construction, or may be formed from different diameters. Optionally, the filaments may include two or more filaments of different construction and/or material.

The tricot is a knitted fabric which can be used as an internal layer for the garment, or a different internal fabric can be used for the internal layer. The face fabric may be a knitted substrate or a woven substrate.

Chromic Material

The textile 100 used to form the garment 10 may be a chromic textile selected from hydrochromic and thermochromic textiles. These chromic textiles 100 include two layers, a pigment layer and a base layer, in which the pigment layer comprises pigment(s) which change visual colour or become transparent when introduced to water or other similar fluids. An opaque film may be included with a hydrochromic textile, with the opaque film becoming transparent with exposure to predetermined fluids, such as water, and subsequently a colour or pattern will be observable through the opaque film which is in a transparent state or a semi-transparent state. The transparent state of the opaque layer will revert to an opaque state as the textile 100 dries.

Similarly, a thermochromic textile may utilises heat sensitive pigment(s) which may become opaque with higher temperatures, such as those produced by a human body when word. The thermochromic textile comprises a pigment layer and a base layer with the pigment layer comprising thermochromic pigments and the base layer having a pattern or colour which can be exposed when the thermochromic pigment is transparent or semi-transparent. The opacity of the pigments will depend on the temperature and therefore it is preferred that with exposure to open water temperatures, generally being less than that of the human body temperature, can revert the pigments to a transparent or a semi-transparent state to allow a colour or pattern covered by the thermochromic layer.

A gradual change of colour may be observed for chromic textiles 100 and may transition from an opaque state to a transparent state (activated state). During transition, the chromic textile may be considered to be in a semi-transparent state. Optionally, portions of the garment 10 may change opacity at different rates to indicate the general temperature of the environment the wearer is in. For example, predetermined locations of a garment 10 may have different chromic pigments which become transparent, opaque or semi-transparent when in contact with a predetermined temperature range. This may allow sections of the garment to change only when certain temperatures are experienced. For example, portions of the garment may comprise a first section with pigments which react in the temperature range of 15° C. to 20° C., and a second section with pigments which react in the temperature range of 10° C. to 15° C., and a third section with pigments which react in the temperature range of 5° C. to 10° C., or any other predetermined temperature ranges. Optionally, temperature ranges of sections of the garment may overlap or partially overlap such that pigments of a first section and a second section will undergo a change in opacity or colour change within the same temperature range.

Optionally, the base material of the chromic textile 100 will be a high visibility material which can be used to more easily spot a wearer with a garment 10 formed with the chromic textile 100. Any base material may be used to more easily identify a wearer at least when a chromic textile is in an activated state, such as high-visibility material, reflective materials or spectral reflective material. It will be appreciated that pigments forming a chromic textile 100 are adapted to react to a any predetermined environment such that the garment can be used A large advantage to having chromic textiles forming at least a portion of a garment is that high-visibility textiles can be hidden when not in the predetermined environment. Optionally, the garment 10 may have any predetermined base layer which may be used for a desired visual appearance which is does not derive a primary use for safety, but rather a fashion or functional appearance.

Chromic textiles may be formed with at least one material selected from the following group; dyes, pigments, conjugated conducting polymers, oxides, and organic molecules. Optionally, photo-chromic materials may also be used which can become transparent or opaque depending on light conditions.

In yet another embodiment, the seals of the garment 10 are adapted to have a chromic change rather than the entire garment. However, it will be appreciated that the torso of the garment or the entire garment may also be formed with a chromic textile 100. Some examples of suitable garments 10 which may utilise the chromic textiles 100 are smocks, jackets, coats, wetsuits, rash-vests and other watersporting articles. These garments may also be applicable for use in construction industries or other industries which experience adverse weather conditions or outdoor conditions which may require a higher visibility at times.

Luminescent Material

Methods in which a phosphorescent material paste may be applied to the membrane or a substrate may include at least one of the following: (a) dipping then nipping, (b) screen printing (c) gravure roll printing, (d) froth or stabilized foam finishing application, (e) knife over roll, (f) knife over pad (g) knife over table, (h) conventional printing systems for textiles, (i) paint spraying unit, and (j) kiss roll applicator/doctor blade. All of these methods may be followed by curing the carrier resin and drying processes if required. Resins used may be transparent or allow for predetermined wavelengths to pass through and excite phosphorescent materials within or under the resin.

Phosphorescent materials which can be applied to the fabric include, but are not limited to: zinc sulphide, calcium sulphide, strontium sulphide, cadmium sulphide, barium sulphide, magnesium sulphide aniline dyes and other colouring pigments or mixtures thereof. These materials possess a "glow in the dark" or luminescent property when exposed to an energy source. Phosphorescent materials can be protected or retained on the substrate with a resin or protective coating.

The face fabric 130 of the garment 10 may have pores or gaps, or be of a thickness which allows for a desired luminosity from a phosphorescent membrane 140 to penetrate the face fabric 130 to be seen. In this way the membrane can be protected and unseen with a face fabric, while also allowing for the luminescent properties to be observed.

Luminescent properties of the membrane 140 may be enhanced or limited by at least one of; altering the colour of the face fabric 130, or by increasing or reducing thicknesses of the face, fabric, altering the emissivity of the face fabric, increasing or reducing the amount of phosphorescent pigments or materials, imparting a pattern or array to the membrane, or changing the chemistry of the phosphorescent source.

Patterns may be provided on the membrane which can be used to impart a desired luminous shape or pattern which can shine through the face fabric.

While it is a common problem for phosphorescent materials to be covered either by a substrate layer or by resin, providing an array or pattern may allow for breathability or functional coatings to remain active. Printing processes may be used to apply a phosphorescent material or coating to a membrane or textile.

In yet another embodiment, the face fabric 130 is coated with a phosphorescent material which is directed towards the membrane 140, or is on the inner side of the face fabric 130. The coating may be sufficient to shine through to the external side of the textile.

Optionally, the garment 10 is a coat 10 as is shown. The coat 10 may be provided with a zipper 90 may be provided on the front panel 30 of the garment 10. In addition, pockets 92 may be provided on the front panel of the garment 10. The pockets on the front panel of the garment may be provided with at least one of; a reinforcing material, a functional coating, a luminescent material or an abrasion resistant structures to improve the comfort of the wearer during use. Optionally, a drainage hole may be provided in the pocket which allows for the pocket 92 to be drained if the pocket receives liquids.

Other features may be provided on the front panel 30 or rear panel 40 of the garment 10. Reflectors, decals, embossing, patterns or any other desired aesthetic may be imparted to the garment 10.

The membrane may be formed from a polyurethane, a polypropylene, PTFE, ETFE, PVC, and woven fibreglass. Other membranes known within the art may also be used to form a portion of the textile. Membranes may be vapour permeable membranes to allow for an improved breathability of the garment, while also being hydrophobic and/or hydrophilic.

It will be appreciated that phosphorescent textiles may not be visually appealing, and therefore it may be advantageous to hide these textiles on the exterior of a garment, such that only when low light conditions exist, the phosphorescent textiles can are visible. The membrane may be coated with a phosphorescent pigment or coating. The membrane may also be further coated with a functional coating.

Textiles such as linens, wools, flannels and organdies and in some cases synthetic textile materials such as Orlon, Daeron and nylon may be used for the first layer or face fabric. Other textiles may be used which can be woven, knitted or braided.

It will be appreciated that any phosphorescent pigment or coating applied to the membrane will allow the membrane to function as intended. Further, the breathability of the membrane is preferably not impacted by the addition of the phosphorescent coating or pigment. Optionally, luminescent coatings applied to the membrane are applied to allow for breathability. In addition, the bond strength between the membrane 140 and the face fabric 130 are generally not adversely affected.

Suitable arrays can include at least one of; a dot matrix, a lattice, chevrons, tessellations, herringbone, houndstooth, gingham, scale, a grid of repeating patterns, or any other desired array. It is preferred that any arrays deposited onto the membrane allows for a suitable level of breathability when in use.

In another embodiment, there may be provided a composite textile having a face material and a membrane. Each of the layers of the textile may have a protective or functional coating applied thereto. Functional coatings may primarily be waterproof coatings, water-resistant coatings, abrasion resistant coatings. Resins can be applied to the layers of the textile to impart a desired functionality.

The heavier or thicker denier yarn can be woven or knitted into the first layer of the textile and can be used to stiffen the first layer of the textile. Improving the stiffness of the face fabric can be achieved by using at least one of; a stiffening yarn, a stiffening film, a resin, a reinforcing strip, a reinforcing means, a stitch, or any other stiffening means. With the inclusion of further stiffening means, the first layer can be stiffened to a desired stiffness, or regions of the first layer can be stiffened to a desired stiffness.

In another embodiment, a rib or strip of material can be applied to the first layer, such that the strips or ribs are positioned between the first layer and the membrane. In this way the rib can be observable through the first layer to provide the desired abrasion resistance or stiffening to a garment 10.

A phosphorescent membrane on the garment may be used to generate a glow or light for the garment. Other properties may also be imparted by using membranes doped, or coated, with a functional chemical or functional material.

Preferably, at least one of a hood and/or the pockets of the garment may be provided with a luminescent material. The hood may conceal the luminescent material, however the luminosity of the luminescent material may be sufficient to allow the glow of said luminescent material to be visible through the surface of the first layer or face fabric.

Optionally, seams or other areas which may assist with outlining a wearer may be lined or provided with luminescent materials to more clearly see the wearer. This is of particular advantage if the wearer is in a darker environment or an environment in which the wearer may not usually be seen. This may also be advantageous for use in wear conditions, especially if the wearer is in the water, and therefore may have utility to identify whether persons have fallen overboard while sailing.

Phosphorescent beads may be disposed on the membrane in a predetermined array or pattern, which may allow for regions on the membrane to provide a higher luminosity.

Luminescent materials may include phosphorescent materials or fluorescent materials. Preferably, phosphorescent materials are used as the delay between absorbing energy and releasing energy as photons allows for a longer period of time between absorbing and emission.

Other materials may be used which can react or interact with electromagnetic radiation. Electromagnetic radiation may include at least one of; visible light, radio waves, gamma rays, X-rays, ultraviolet light or any other electromagnetic spectrum radiation which can allow for excitation of a material to cause photon release.

As shown, the hood 50 of the garment 10 may have regions 180 in which the phosphorescent material is disposed, and regions which the material is absent. Having the hood opening near to the eyes free from luminescent materials may assist with maintaining a desired visibility for the wearer by reducing light pollution local the eyes of the wearer. Further, the hood may be provided with a plurality of regions with a luminescent glow of different intensities. Varying intensities may be used to highlight regions of the coat more effectively which can be of particular advantage for regions which do not receive common exposure Optionally, a membrane may be printed with an array or pattern of luminescent material rather than doped with a luminescent material. In another example, a printed transfer may be used to deposit a luminescent material onto the membrane. Application of luminescent material onto the membrane will not impact the functional properties of the membrane and preferably have little to negligible impact in relation to breathability of the garment.

In yet another embodiment, the primary and secondary yarns of the textile may be 320 denier to 500 denier nylon or polyester fabric, or similar. Colours of the yarns may be high-visibility yellow, may be black yarns, grey yarns, or any other predetermined colour. Colours may be used to highlight or bring attention to specific portions of the garment.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A garment for watersports, the garment comprising;

a first textile comprising a face fabric and a membrane, the face fabric being fixed to the membrane; and a second textile fixed with the same side of the membrane as that of the face fabric of the first textile;

the second textile configured to be adjacent to the face fabric of the first textile;

wherein the first textile comprises primary yarns and secondary yarns in which the secondary yarns have a higher stiffness relative to the primary yarns;

the first textile comprises reinforcing structures, said reinforcing structures being formed of secondary yarns clustered into elements that project from an outer surface of the textile; and the second textile is formed from yarns which are relatively less stiff than the secondary yarns of the first textile.

2. The garment as claimed in claim 1, wherein the secondary yarns comprise at least one filament selected from the following group: glass, aramid, ceramic, graphite (or carbon), metal alloys and metal fibers.

3. The garment as claimed in claim 1, wherein a knitted layer is disposed adjacent to the membrane.

4. The garment as claimed in claim 3, wherein the knitted layer and the face fabric are disposed on respective sides of the membrane.

5. The garment as claimed in claim 1, wherein luminescent materials may be provided to at least one of the face fabric and the membrane.

6. The garment as claimed in claim 1, further comprising a hood.

7. The garment as claimed in claim 1, wherein the primary yarns are first stiffening yarns, such that a seat region of the garment is formed with a second stiffening yarn of a relatively larger denier than the first stiffening yarn.

8. The garment as claimed in claim 1, wherein predetermined regions of the garment are formed with a reinforcing structure.

9. The garment as claimed in claim 1, wherein the secondary yarns are resiliently biased.

10. The garment as claimed in claim 1, wherein the secondary yarns form an abrasion resistant structure.

11. The garment as claimed in claim 10, wherein the abrasion resistant structure is separate to the reinforcing structures.

12. The garment as claimed in claim 10, wherein the abrasion resistant structure is provided by the reinforcing structures.

13. The garment as claimed in claim 1, further comprising at least one of a film layer and a base layer coupled with the membrane.

14. The garment as claimed in claim 1, wherein the textile has a chromic material deposited thereon.

15. The garment as claimed in claim 1, wherein the face fabric comprises the primary and secondary yarns; and the reinforcing structures outwardly project from the face fabric in a direction substantially away from the membrane.

* * * * *